United States Patent [19]

Roller

[11] 4,365,794

[45] Dec. 28, 1982

[54] TOGGLE ARM INVERTER

[75] Inventor: George J. Roller, Rochester, NY

[73] Assignee: Xerox Corporation, Stamford, Conn.

[21] Appl. No.: 193,227

[22] Filed: Oct. 2, 1980

[51] Int. Cl.[3] ..... B65H 29/00

[52] U.S. Cl. ..... 271/186; 271/291

[58] Field of Search ..... 271/225, 291, 65, 186, 271/DIG. 9; 226/49, 50

[56] References Cited

U.S. PATENT DOCUMENTS

| | | | |
|---|---|---|---|
| 2,901,246 | 8/1959 | Wagner . | |
| 3,490,666 | 1/1970 | Takashino | 226/50 X |
| 3,537,661 | 11/1970 | Isom | 226/191 |
| 3,761,075 | 9/1973 | van Namen | 271/DIG. 9 X |
| 3,942,785 | 3/1976 | Stange | 271/65 |
| 4,078,789 | 3/1970 | Kittredge et al. | 271/65 |
| 4,200,386 | 4/1980 | Queener | 271/291 X |

OTHER PUBLICATIONS

IBM Technical Disclosure Bulletin, vol. 18, No. 1, p. 40, Jun. 1975. "Sheet Turnover Device," S. R. Harding.

*Primary Examiner*—Richard A. Schacher
*Attorney, Agent, or Firm*—William A. Henry

[57] ABSTRACT

A copier capable of producing simplex and duplex copies includes an inverter that has constantly rotating input and output rollers mounted for pivotal movement into and out of engagement with a reversibly rotatable sleeve that is mounted on a stationary shaft. When inversion of a sheet is required, a shiftable gate deflects the sheet into a nip formed between the input rollers and the rotatable sleeve. A sensor senses the trail edge of the sheet and through a controller causes a reversible drive motor to pivot the input rollers out of engagement with the sleeve while simultaneously placing the output rollers into driving engagement with the sleeve. The sheet is then driven by the output rollers out of the inverter and back into the paper path of the copier for further processing.

4 Claims, 3 Drawing Figures

TOGGLE ARM INVERTER

The present invention relates to an improved sheet inverting system, and more particularly to a compact inverter that provides improved handling of variable sized sheets and requires a minimum of space.

As xerographic and other copiers increase in speed, and become more automatic, it is increasingly important to provide higher speed yet more reliable and more automatic handling of both the copy sheets being made by the copier and the original document sheets being copied. It is desired to accommodate sheets which may vary widely in size, weight, thickness, material, condition, humidity, age, etc. These variations change the beam strength or flexural resistance and other characteristics of the sheets. Yet the desire for automatic and high speed handling of such sheets without jams, misfeeds, uneven feeding times, or other interruptions increases the need for reliability of all sheet handling components. A sheet inverter is one such sheet handling component with particular reliability problems.

Although a sheet inverter is referred to in the copier art as an "inverter", its function is not necessary to immediately turn the sheet over (i.e., exchange one face for the other). Its function is to effectively reverse the sheet orientation in its direction of motion. That is, to reverse the lead edge and trial edge orientation of the sheet. Typically in inverter devices, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion. The present invention may be utilized, for example, as the inverter of a simple/duplex copying system of the type disclosed in U.S. Pat. application Ser. No. 71,613, filed Aug. 31, 1979, by the same Assignee, in the name of Ravi B. Sahay.

Tri-roll inverters have been used in copiers in the past, however, due to space constraints, it has often been infeasible to incorporate a tri-roll type inverter with its convenient and distinct entrance and exit nips. In this situation, the solution was to incorporate a single nip inverter with a means of paper direction reversal incorporated within this nip. This type of inverter requires a positive type of gating system to insure that the inverted sheet does not exit into the path of incoming sheets.

The inverter of the present invention alleviates both of the aforementioned problems with a minimum degree of complexity by providing simple, low cost inverter apparatus that pivots between input and output positions.

A preferred feature of the present invention is to provide an inverter having an inverting path for use in a substrate conveying apparatus, comprising first means for forwarding a substrate into said inverting path, second means for forwarding a substrate out of said inverting path, and pivot means for drivingly connecting either said first or second forwarding means to the substrate.

Further features and advantages of the invention pertain to the particular apparatus whereby the above-noted aspects of the invention are attained. Accordingly, the invention will be better understood by reference to the following description, and to the drawings forming of part thereof, which are approximately to scale, wherein.

Figure 1:
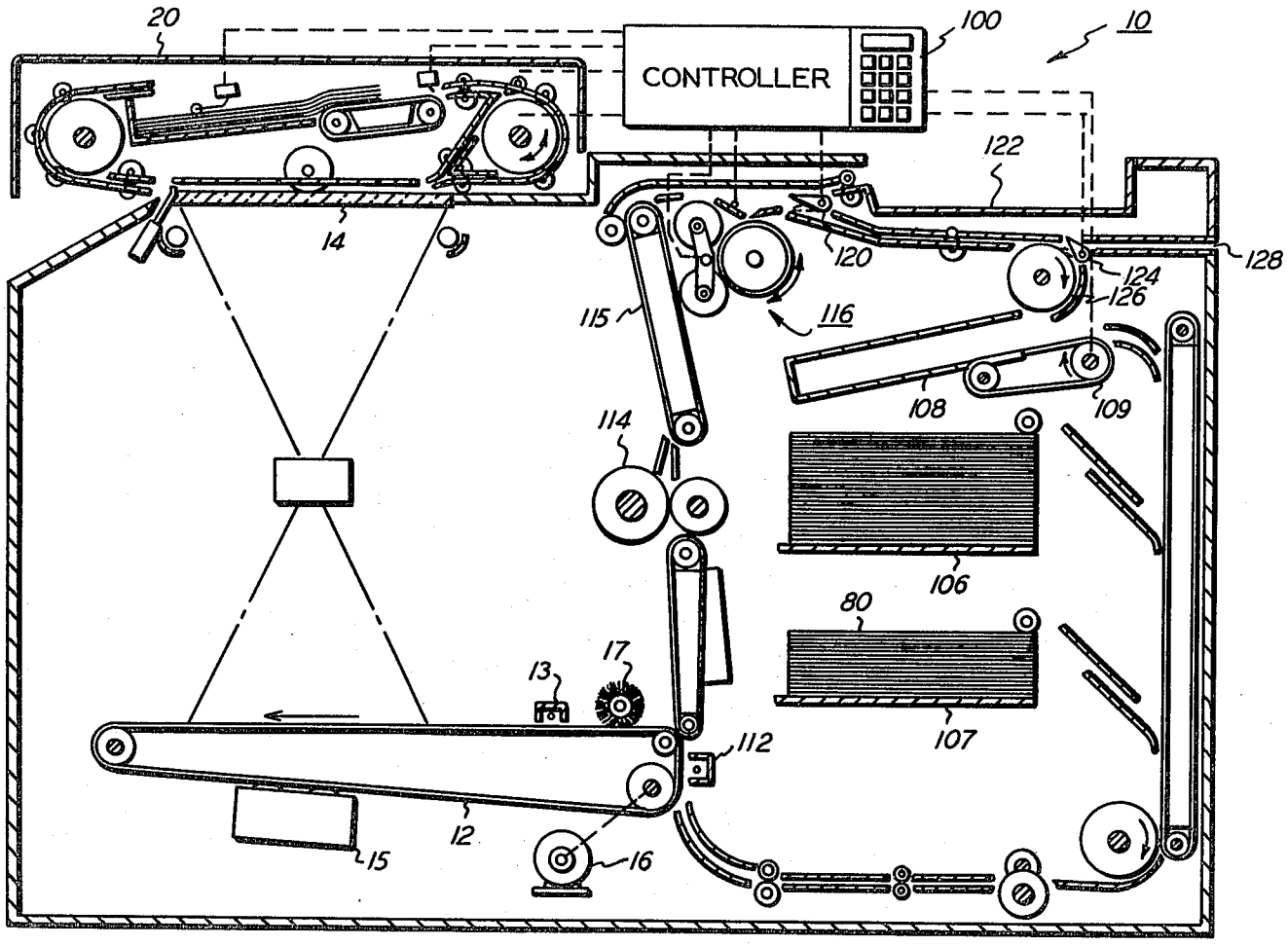
FIG. 1 is a schematic side view of an exemplary copier incorporating an aspect of the present invention.

Referring to the exemplary xerographic copier 10 shown in FIG. 1, and its exemplary automatic document feeding unit 20, it will be appreciated that various other recirculating document feeding units and copiers may be utilized with the present invention. This copier is described in detail in U.S. application Ser. No. 71,613, filed Aug. 31, 1979, and is incorporated herein by reference to the extent necessary for the practice of the present invention.

The exemplary copier 10 conventionally includes a xerographic photoreceptor belt 12 and the xerographic stations acting thereon for respectively charging 13, exposing 14, developing 15, driving 16 and cleaning 17. The copier 10 is adapted to provide duplex or simplex pre-collated copy sets from either duplex or simplex original documents copied from the recirculating document handler 20. Two separate copy sheet trays 106 and 107 are provided to feed clean copy sheets from either one. The control of the sheet feeding is, conventionally, by the machine controller 100. The controller 100 is preferably a known programmable microprocessor as exemplified by U.S. Pat. No. 4,144,450, issued to J. Donahue et al. on Mar. 13, 1979, which conventionally also controls all of the other machine functions described herein including the operation of the document feeder, the document and copy sheet gates, the feeder drives, etc., and is incorporated herein by reference. As further disclosed, it also conventionally provides for storage and comparison of the counts of the copy sheets, the number of documents recirculated in a document set, the number of copy sets selected by the operator through the switches thereon, etc.

The copy sheets are fed from a selected one of the trays 106 or 107 to the xerographic transfer station 112 for the transfer of the xerographic image of a document page to one side thereof. The copy sheets here are than fed through vacuum transports vertically up through a conventional roll fuser 114 for the fusing of the toner image thereon. From the fuser, the copy sheets are fed to a gate 118 which functions as an inverter selector finger. Depending on the position of the gate 118, the copy sheets will either be deflected into a sheet inverter 116 or bypass the inverter and be fed directly onto a second decision gate 120. Those copy sheets which bypass the inverter 116 (the normal path here) have a 90° path deflection before reaching the gate 120 which inverts the copy sheets into a face-up orientation, i.e., the image side which has just been transferred and fused is face-up at this point. The second decision gate 120 then either deflects the sheets without inversion directly into an output tray 122 or deflects the sheets into a transport path which carries them on without inversion to a third decision gate 124. This third gate 124 either passes the sheets directly on without inversion into the output path 128 of the copier, or deflects the sheets into a duplex inverting roller transport 126. The inverting transport 126 feeds the copy sheets into a duplex tray 108. The duplex tray 108 provides intermediate or buffer storage for those copy sheets which have been printed on one side and on which it is desired to subsequently print an image on the opposite side thereof., i.e., the sheets being duplexed. Due to the sheet inverting by the roller 126, these buffer set copy sheets are stacked into the duplex tray face-down. They are stacked in the duplex tray 108 on top of one another in the order in which they were copied.

For the completion of duplex copying, the previously simplexed copy sheets in the tray 108 are fed seriatim by the bottom feeder 109 from the duplex tray back to the transfer station for the imaging of their second or opposite side page image. This duplex copy sheet path is basically the same copy sheet path provided for the clean sheets from the trays 106 or 107, illustrated at the right hand and bottom of FIG. 1. It may be seen that this sheet feed path between the duplex feeder 109 and the transfer station 112 inverts the copy sheets once. However, due to the inverting roller 126 having previously stacked these sheets face-down in the tray 108, they are presented to the transfer station 112 in the proper orientation, i.e., with their blank or opposite sides facing the photoreceptor 12 to receive the second side image. The now duplexed copy sheets are then fed out through the same output path through the fuser 114 past the inverter 116 to be stacked with the second printed side faceup. These completed duplex copy sheets may then be stacked in the output tray 112 or fed out past the gate 124 into the output path 128.

The output path 128 transports the finished copy sheets (simplex or duplex) either to another output tray, or, preferably, to a finishing station where the completed pre-collated copy sheets may be separated and finished by on-line stapling, stitching, glueing, binding, and/of off-set stacking.

Figure 2:
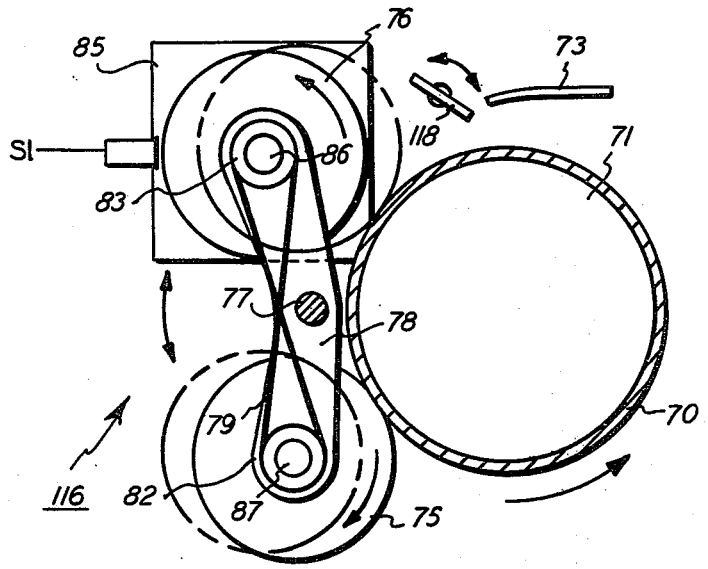
FIG. 2 is an exploded side view of the inverter shown in FIG. 1.

In reference to an aspect of the present invention and FIG. 2, when inversion of copy sheets is required, for example, job recovery, maintaining face-up or face-down output collation, simplex or duplex copying from an odd number of duplex copies, etc., toggle-arm inverter 116 is used. Copy sheets are fed from either tray 106 or 107 past transfer means 112 and onto conveyor 115. As the sheet leaves conveyor 115, it approaches decision gate 118 which is controlled by controller 100. Gate 118 is actuated to the right as viewed in FIG. 1 for sheet 80 to be deflected into an input nip formed between idler roller 71 that has a plastic or nylon sleeve 70 mounted thereon and constantly running input drive rollers 75.

A sheet 80 is deflected by gate 118 into rollers 75 that drives the sheet into the inverter. When the trail edge of the sheet is sensed, either by timing or the use of sensors, toggle arm carriage 78 is caused to rotate by conventional means about pivot point 77 from the solid line position shown to a second position that places rollers 75 and 76 in the dotted line positions. This pivot point could be located at any convenient area of the machine. Upon rotation of carriage 78, the trail edge of the sheet is forced into the exit path located beneath guide member 73. In this position, constantly rotating drive rollers 76 upon contact with idler roller sleeve 70 drives the sheet out of the inverter. Because of the large size required of the idler roll 71, sheet to roll slip will occur unless the idler roll inertia is small in comparison to the driving rolls 75 and 76. To compensate for this, and hence, to minimize smear and tear problems, the idler roll may be a large fixed shaft with a very light plastic or nylon sleeve mounted concentrically upon it. The driving rolls will then contact the extremely low inertia sleeve instead of rotating the larger mass.

Figure 3:
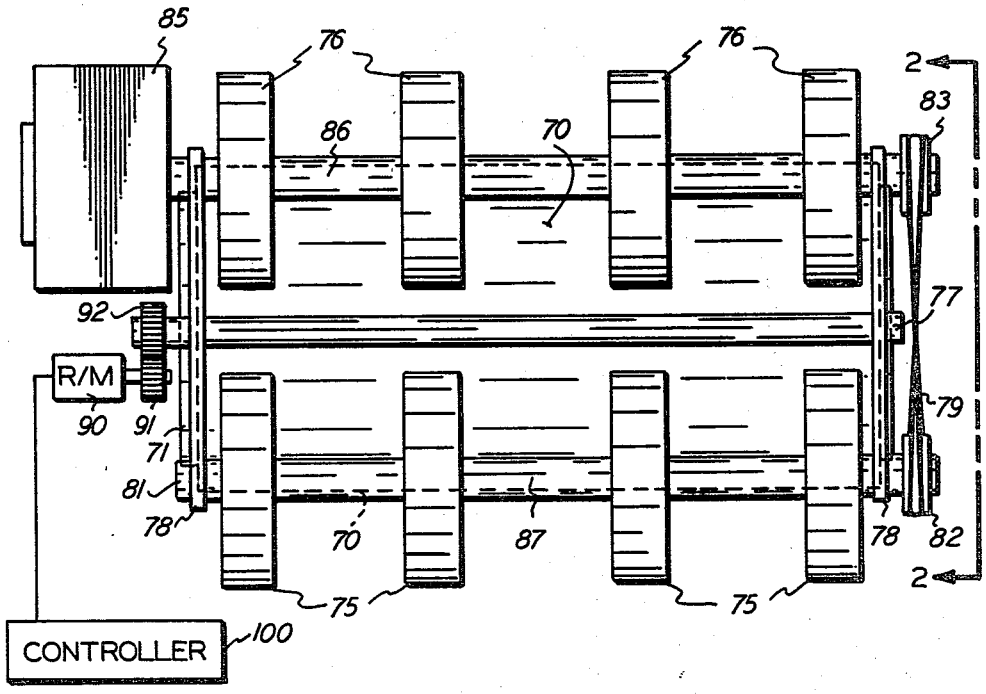
FIG. 3 is a partial end view of the invention in FIG. 2.

In FIG. 3, drive motor 85 is shown connected through shafts 86 and 87 and drive belt 79 that is mounted on pulleys 82 and 83. Motor 85 which can be connected to the ON/OFF switch of the machine causes constant rotation of drive rolls 75 and 76 and rolls 75 are in contact with sleeve 70 except when trail edge sensor S1 is actuated. After a sheet has entered the inverter and is being driven downward as viewed in FIG. 2, the trail edge of the sheet is sensed by sensor S1 which supplies a signal to controller 100. The controller in turn sends a signal to reversible drive motor 90 which in turn rotates gears 91 and 92 and thereby pivots shaft 77 that places rolls 76 into engagement with rotatable sleeve 70. A nip formed between rolls 76, and sleeve 70 will engage the sheet previously sensed and forward it toward decision gate 120. After the sheet has been fed out of the inverter, reversible drive motor 90 drives shaft 77 in the reverse direction and thereby places rolls 75 into contact with sleeve 70 so that another sheet can be driven into the inverter.

In conclusion, a substrate inverter is disclosed that includes input and output rollers 75 and 76, respectively, that are mounted on a toggle arm bracket 78 that pivots about shaft 77 adjacent reversibly rotatable sleeve 70 mounted on fixed member 71. A sheet is deflected into the inverter by a pivotable gate 118 and is acquired by an input nip formed between rollers 75 and sleeve 70. When the trail edge of the sheet is sensed, toggle arm 78 is caused to rotate and place output rollers 76 into contact with sleeve 70. The trail edge of the sheet is contacted by rollers 76 and driven out of the inverter into a path toward decision gate 120.

While the inverter system disclosed herein is preferred, it will be appreciated that various alternatives, modifications, variations or improvements thereon may be made by those skilled in the art, and the following claims are intended to encompass all of those falling within the true spirit and scope of the invention.

What is claimed is:

1. Inverter device having an inverting path for use in a sheet conveying apparatus, comprising:

first roller means mounted on a first shaft for forwarding a sheet into said inverting path;

second roller means mounted on a second shaft for forwarding a sheet out of said inverting path, said first and second shafts being supported by brackets that are pivotally connected to a rotatable third shaft;

reversible drive means connected to said third shaft; and pivot means for drivingly connecting either said first or second roller means to said sheet as a result of actuation of said reversible drive means.

2. The inverter of claim 1, wherein said first and second roller means are pivoted as a unit.

3. The inverter of claim 1, wherein said first and second roller means form nips alternately with a sleeve rotatably mounted on a stationary shaft.

4. The inverter of claim 3, wherein said sleeve is made of plastic.

* * * * *